US007594646B2

(12) United States Patent
Flagg et al.

(10) Patent No.: US 7,594,646 B2
(45) Date of Patent: Sep. 29, 2009

(54) CARTON MAGAZINE WITH CONTROL SENSOR

(75) Inventors: Michael F. Flagg, Newman, GA (US); John W. Cash, III, Dallas, GA (US); Rafe T. Patterson, Fortson, GA (US)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 416 days.

(21) Appl. No.: 11/428,245

(22) Filed: Jun. 30, 2006

(65) Prior Publication Data

US 2007/0001363 A1 Jan. 4, 2007

Related U.S. Application Data

(60) Provisional application No. 60/696,379, filed on Jul. 1, 2005.

(51) Int. Cl.
*B65H 5/00* (2006.01)

(52) U.S. Cl. ..... 271/3.12; 271/150

(58) Field of Classification Search ..... 271/147, 271/148, 149, 150, 152, 153, 3.12, 3.01
See application file for complete search history.

(56) References Cited

U.S. PATENT DOCUMENTS 4,934,682 A * 6/1990 Rece et al. ..... 271/3.12
4,973,038 A * 11/1990 Curley et al. ..... 271/146
5,211,529 A * 5/1993 Esala et al. ..... 414/795.8
5,284,335 A * 2/1994 Golicz ..... 271/149

* cited by examiner

*Primary Examiner*—Kaitlin S Joerger
(74) *Attorney, Agent, or Firm*—Karen L. Ware

(57) ABSTRACT

An infeed station for conveying and positioning a stack of carton blanks for sequential removal by a carton feeder, for automatically adjusting the rate of advancement of the carton blanks to compensate for excessive tilting and gaps between the carton blanks, and for providing alerts to signal the need for operator intervention or automatic shutdown. The infeed station includes a hopper and a magazine that receives carton blanks from the hopper. The magazine includes a sensing mechanism including a control sensor and a warning sensor mounted in proximity to the carton blanks in the infeed station, and a processor that, according to a condition signaled by the sensing mechanism, controls the rate at which advancing belts advance a queue of carton blanks toward the magazine.

8 Claims, 7 Drawing Sheets

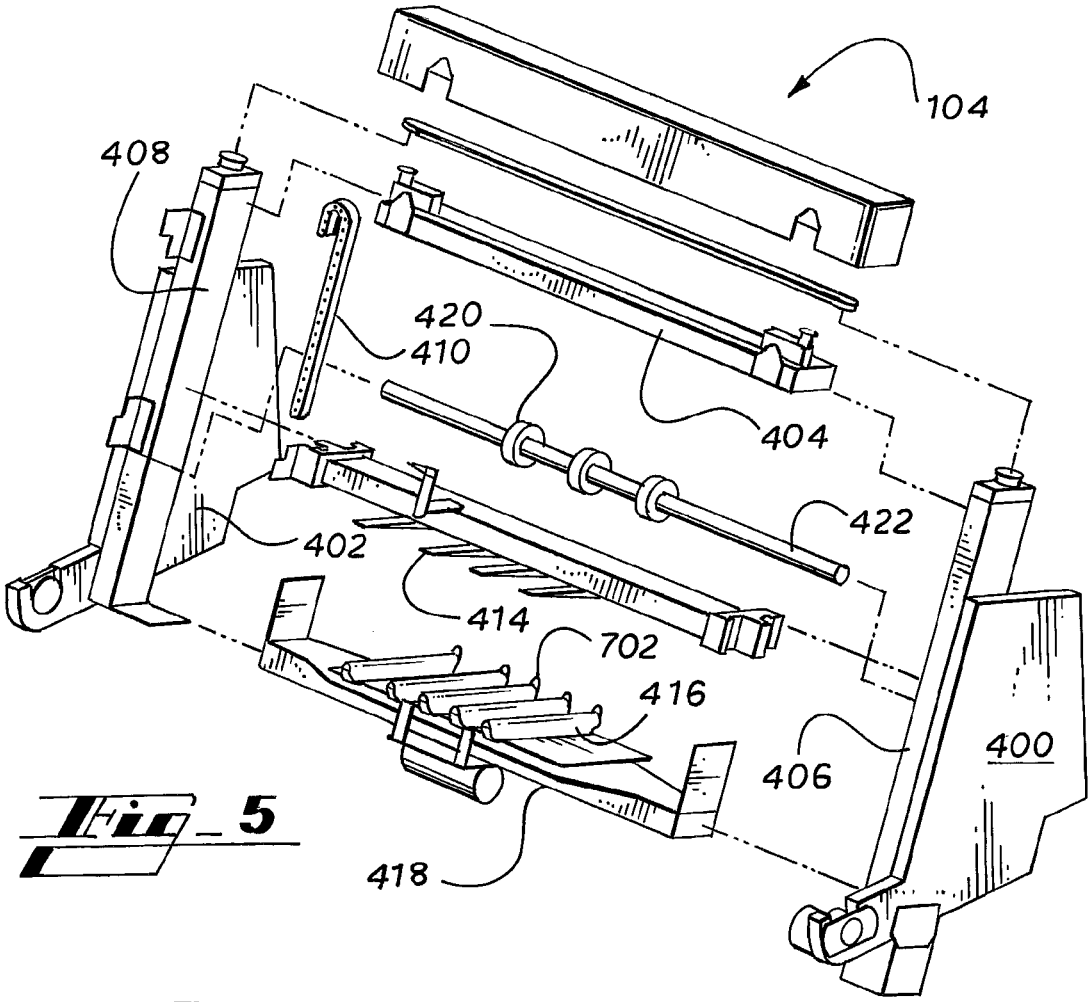
Fig_5
Fig_6
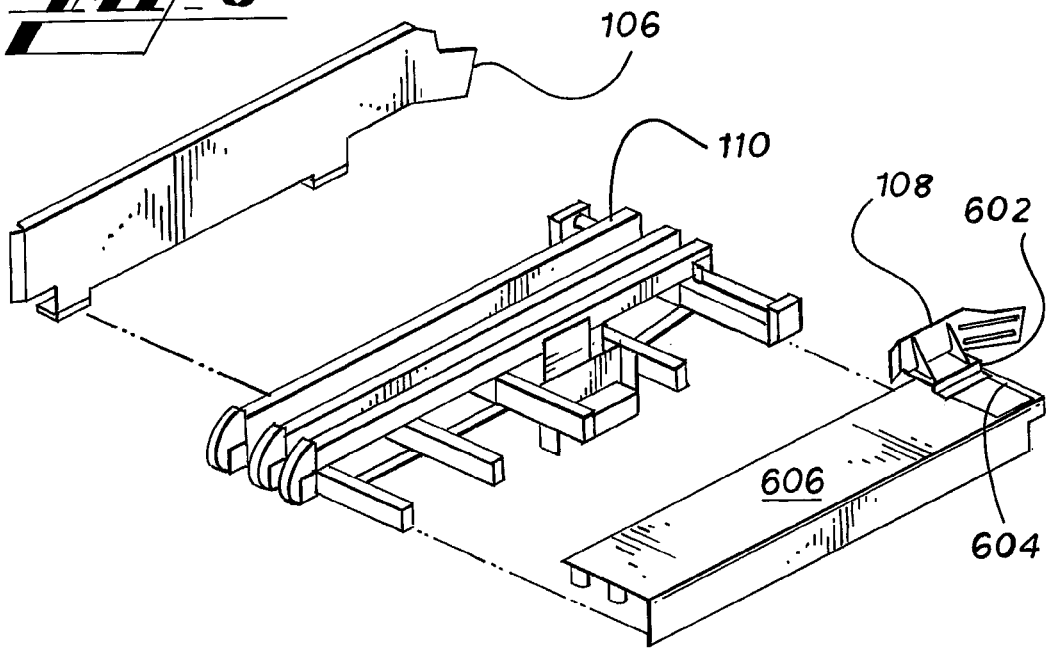

| Condition | State of Warning Sensor 112 | State of Control Sensor 114 | Response of PLC 200 | Notes |
|---|---|---|---|---|
| A | Detected | Detected | No response | Hopper full, tilt ok |
| B | Detected | Not detected | Advance belts | Hopper full, tilted |
| C | Not detected | Detected | Issue warning | Hopper empty tilt ok |
| D | Not detected | Not detected | Shut down | Hopper empty out of carton blanks |

CARTON MAGAZINE WITH CONTROL SENSOR

RELATED APPLICATIONS

This application claims priority to U.S. Application No. 60/696,379, filed Jul. 1, 2005, the entirety of which is incorporated herein by reference.

TECHNICAL FIELD

This invention relates generally to machines for erecting cartons, and more particularly, a carton magazine with a control sensor that compensates for inconsistent loading of cartons in a packaging machine.

BACKGROUND OF THE INVENTION

A continuous-motion automatic packaging machine rapidly applies secondary packaging to multiple individually packaged products such as canned or bottled consumables for greater ease of transportation, storage, sale, and consumer utilization. A typical packaging machine integrates several modular stations, including a carton erector, case packer, carton sealing station, palletiser, and interconnecting conveyor systems that convey the products through the various modular stations and into each of a series of cartons. It is known to provide a packaging machine with a modular or integral carton feeder that erects cartons, such as sleeve type cartons provided as carton blanks that are partially assembled and collapsed into tubular sleeves prior to being fed into the packaging machine. A typical carton feeder includes three rotary vacuum wheels, each including vacuum cups for engaging and disengaging cartons that are selectively activated and deactivated by means of valves controlled by a computer processor.

When the packaging machine is running, it is critical to supply the carton feeder with a steady stream of carton blanks, which may be folded beforehand and secured into a pre-erected configuration, such as flattened tubular sleeves or flattened basket-style carriers. An operator loads the carton blanks into a hopper, which then conveys the carton blanks to the feeder on advancing belts that are continuously or intermittently driven. In order for the feeder wheel to efficiently engage each carton, the cartons must be consistently stacked. Thus, such packaging machines are sensitive to the manner in which the operator fills the hopper—requiring loading to be extremely orderly and consistent. Gaps between carton blanks cause the blanks to tilt, resulting in more frequent misses by the feeder wheel. Conversely, overcompensating for gaps by overdriving the advancing belts of the hopper causes the carton blanks to press against one another excessively, again increasing the occurrence of misses by the feeder wheel as well as increasing the likelihood that carton blanks will be expelled prematurely.

Attempts to compensate for this sensitivity include creating a pressure break that reduces the pressure translated from the line of carton blanks in the hopper to the feeder wheel. The pressure break is created by interposing a magazine between the feeder wheel and the hopper. The transition between the hopper and the magazine is stepped down significantly such that the cartons blanks in the magazine are several inches lower than the carton blanks in the hopper. Because the hopper is separate from the magazine, the magazine needs separately driven roller belts to convey carton blanks toward the feeder wheel. Although such configurations may reduce the pressure in the magazine, there is still no guarantee that the advancing belt will not run excessively to exceed the ability of the pressure break to adequately relieve the pressure. Furthermore, the inclusion of separate roller belts significantly limits the ability of such magazines to support the weight of the carton blanks.

There is a need, therefore, for a packaging machine having an infeed station that is less sensitive to filling anomalies, and that reduces the likelihood of misfeeds.

SUMMARY OF THE INVENTION

The various embodiments of the present invention overcome the shortcomings of the prior art by providing systems and methods for operating an infeed station. The infeed station includes a magazine that is tolerant of inconsistent loading of a hopper and includes a sensing mechanism that limits the pressure on the carton blanks in the carton magazine. The magazine includes fixed supports that can bear the weight of numerous carton blanks.

Generally described, the systems and methods of the present invention include an infeed station for stacking the carton blanks for sequential removal by a carton feeder. The infeed station includes a hopper and a magazine for receiving carton blanks from a hopper. The magazine includes a sensing mechanism including a control sensor and optionally, a warning sensor, that are mounted in proximity to the carton blanks in the infeed station. The sensing mechanism controls advancing belts that are associated with the hopper, for example, to advance additional carton blanks into or toward the magazine or to close gaps between a queue of carton blanks already loaded in the hopper. Generally described, the sensing mechanism detects conditions such as whether carton blanks in the infeed station are excessively tilted and whether the hopper and the magazine are full, and signals a corresponding condition to a PLC (Programmable Logic Controller) or other processor. If the infeed station is fully loaded and the carton blanks are sufficiently upright, the PLC slows, disables, disengages, or brakes the advancing belts or otherwise prevents a drive system from causing the belts to advance beyond what is needed to sustain the fully loaded condition.

The hopper queue is separated from the magazine stack by a transition region created by disposing the magazine at a slightly lower elevation with respect to the hopper. Thus, carton blanks conveyed in the hopper drop down into the magazine upon being conveyed into the transition region. The relative disparity in elevation also causes at least the frontmost carton blanks in the hopper queue, i.e. just upstream from the transition region, to tilt toward or lean slightly against the stack in the magazine. This pressure, combined with a bottom surface of the magazine that slopes toward the carton feeder, drives the stack toward the carton feeder. The pressure is limited, however, by ensuring that the carton blanks in the hopper queue do not lean excessively onto the stack.

To detect excessive tilting or leaning, which also may indicate that the magazine is not full, the control sensor monitors the elevation of the top edges of the endmost carton blanks in the hopper queue. This elevation indicates whether the carton blanks in the hopper queue are tilting or leaning excessively toward the stack. When the carton blanks tilt or lean excessively, the distance between the top edges of the carton blanks and the control sensor exceeds the sensing range of the control sensor, and a corresponding state is indicated by the control sensor. This state or a condition defined by multiple states is detected by the PLC, which causes the advancing belts to advance, thereby raising the elevation of the endmost carton blanks in the hopper queue and filling the magazine. If advancing the advancing belts does not fill the magazine, the sensing mechanism detects that the queue has been depleted and the packaging machine is eventually shut down by the PLC. In other instances, the configuration permits running the advancing belts of the hopper as needed to ensure a steady supply of carton blanks to the magazine.

The invention reduces the sensitivity of the packaging machine to loading anomalies in which the operator fails to load cartons in such a manner to eliminate gaps between adjacent carton blanks. In addition, a warning sensor is provided to alert the operator of the need to load additional carton blanks in the hopper to ensure continuous operation of the packaging machine. In the embodiments described herein, the warning sensor is disposed beneath the advancing belts and upstream from the magazine to detect carton blanks passing above it on the advancing belts. If carton blanks are not detected for a given period of time, an audible, visible, vibratory or other detectable warning signal is issued to notify a human or automated operator to load the hopper.

An aspect of the invention is the interoperability of the warning sensor and the control sensor. Specifically, the states of both sensors can be combined to define certain conditions to which the PLC will respond or trigger a response. If both sensors detect carton blanks, then the PLC does not advance the belts. If the warning sensor detects carton blanks in the hopper queue, but the control sensor does not detect carton blanks at the proper elevation, the advancing belts advance to right the carton blanks entering the transition region, thereby ensuring a full magazine and preventing excessive tilting or leaning of carton blanks in the hopper queue. If the warning sensor does not detect carton blanks and the control sensor does detect carton blanks at the proper elevation, a warning signal is issued to notify the operator to load more cartons. The warning signal may be delayed for a given period of time in case the failure of the warning sensor to detect is simply caused by gaps between adjacent cartons due to filling anomalies. Several repeating or escalating warning signals may issue to indicate as time elapses after the first warning signal to indicate the urgency of preventing the hopper from completely being depleted before the operator reloads. If the warning sensor fails to detect carton blanks in the queue in the hopper, and the control sensor also fails to detect carton blanks, then the packaging machine shuts down due to lack of carton blanks. The shut down may also be delayed for a predetermined time calculated to fully exhaust the supply of carton blanks in the magazine prior to the failure of the control sensor to detect carton blanks.

According to another aspect of the invention, the magazine includes bottom supports that can bear the weight of as many carton blanks as the magazine can hold. The supports are substantially rigid with generally smooth upper surfaces that minimize the friction imparted to the bottom edges of the carton blanks that move across the supports and into the carton feeder. The carton blanks are driven across the supports by the controlled amount of pressure generated by the top edges of the carton blanks in the hopper queue, which ideally lean slightly onto the stack of carton blanks in the magazine.

The foregoing has broadly outlined some of the aspects and features of the present invention, which should be construed to be merely illustrative of various potential applications of the invention. Other beneficial results can be obtained by applying the disclosed information in a different manner or by combining various aspects of the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

BRIEF DESCRIPTION OF THE DRAWINGS

FIG. 5 is an exploded view of the magazine of FIG. 4.

FIG. 6 is an exploded view of the carton hopper of FIG. 1.

DETAILED DESCRIPTION

Figure 1:
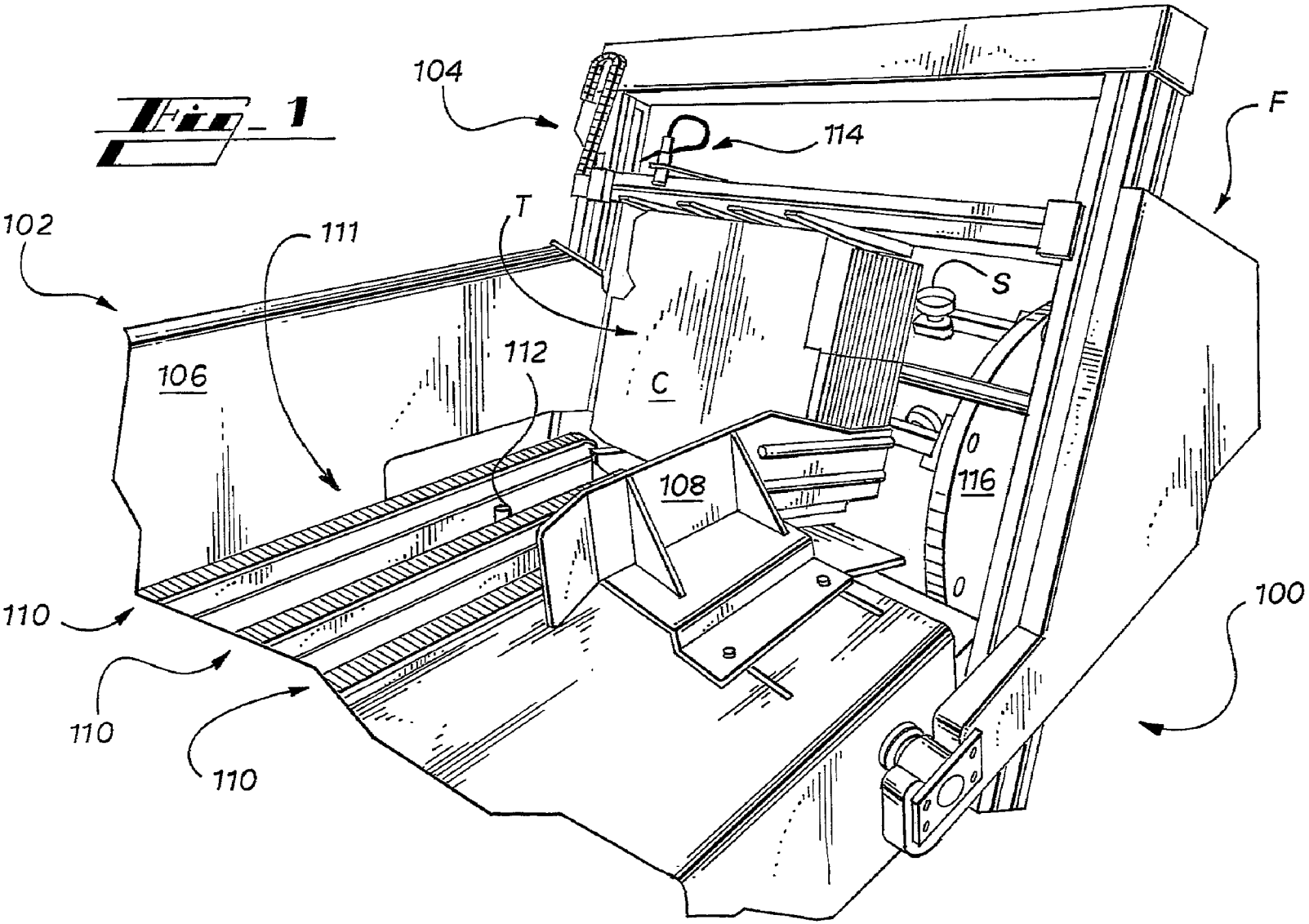
FIG. 1 is a partial perspective view of an infeed station of a packaging machine that incorporates an exemplary magazine and an exemplary carton hopper according to the present invention.

As required, detailed embodiments of the present invention are disclosed herein. It must be understood that the disclosed embodiments are merely exemplary of the invention that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present invention. Therefore, specific structural and functional details disclosed herein are not to be interpreted as limiting, but merely as a basis for the claims and as a representative basis for teaching one skilled in the art to variously employ the present invention.

Referring now to the drawings in which like numerals indicate like elements throughout the several views, the drawings illustrate certain of the various aspects of exemplary embodiments of an infeed station of the present invention. The infeed station is shown and described in the context of an exemplary packaging machine for erecting and loading paperboard cartons, article carriers, or other packages, although the principles and features of the invention are useful in similar packaging machines and with articles similar to the cartons described. As such, the exemplary cartons may be formed from materials other than paperboard, and indeed from any suitable sheet material that is substantially flat or foldable into a flattened, such as but not limited to, corrugated board, plastic, and the like.

An exemplary infeed station 100 for a carton feeder F of an exemplary packaging machine is shown in FIG. 1. The infeed station 100 includes a hopper 102 and a magazine 104. The hopper 102 holds a queue Q (shown in FIG. 7) of carton blanks C that stand on their bottom edges and the magazine 104 holds a stack T of carton blanks C that stand on their bottom edges. The queue Q of carton blanks C are conveyed from the hopper 102 into the magazine 104, where the carton blanks C are held in the stack T prior to being removed one by one by vacuum cup stations S on a pickup wheel 116 of the carton feeder F (partially obstructed). Thereby, carton blanks C move from the rear of the infeed station 100 toward the front of the infeed station 100. As used herein, the terms "rear" and "front" refer to relative positions of objects along the length of the infeed station 100 and, specifically, along the path of the carton blanks C within the infeed station 100.

The hopper 102 includes a conveyor 111 or other means for conveying the queue Q of carton blanks C into the magazine 104. The bottom edges of the queue Q of carton blanks C rest transversely across means for conveying of the hopper 102. In the exemplary embodiment, the conveyor 111 includes a set of one or more advancing belts 110, although any suitable apparatus for orderly conveyance or other means for conveying can be substituted, including a single advancing belt, a vibrating table, a system of carts, a roller bed, a conveying surface, and the like.

The advancing belts 110 shown in FIG. 1 are toothed or serrated roller belts, which are known for use in various conveying applications. In the exemplary embodiment, the advancing belts 110 are run in a single direction to move the queue Q of carton blanks C forward toward the magazine 104. However, reciprocating belts, which convey a load of carton blanks C to the magazine 104 and then reverse to be reloaded, are contemplated as well. In any event, the advancing belts 110 may be driven by a single motor (not shown) or a synchronized set of motors (not shown). The operation and drive speed of the motor or motors is controlled by a programmable logic controller (PLC) 200 (shown in FIG. 2) or other processing device that includes program logic and circuitry which facilitates controlling motors and other peripheral devices.

The exemplary hopper 102 further includes guides 106, 108 that provide lateral support to opposing side edges of the carton blanks C in the queue Q. Guide 106 extends along the entire length of the advancing belts 110, as shown in FIG. 6. Guide 108 is disposed adjacent to the magazine 104 and is adjustable such that the distance between the guides 106, 108, or otherwise the width of the hopper 102, can be changed to accommodate carton blanks C having various dimensions. Referring to FIG. 6, the guide 108 can be adjusted by loosening thumb screws 602 and sliding the screws 602 within respective slots 604 that are machined in a hopper table 606.

Figure 4:
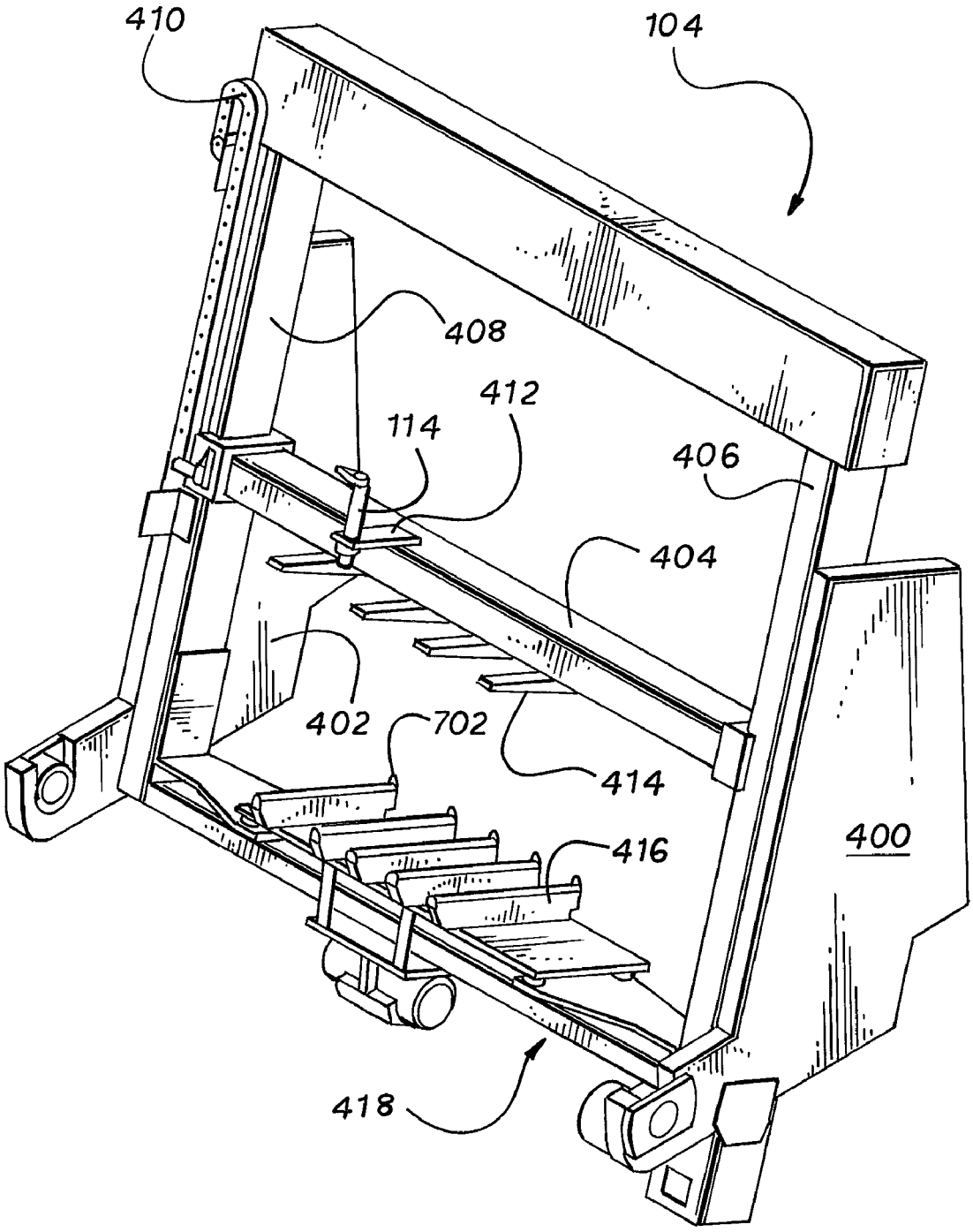
FIG. 4 is a perspective view of the magazine of FIG. 1.
Figure 7:
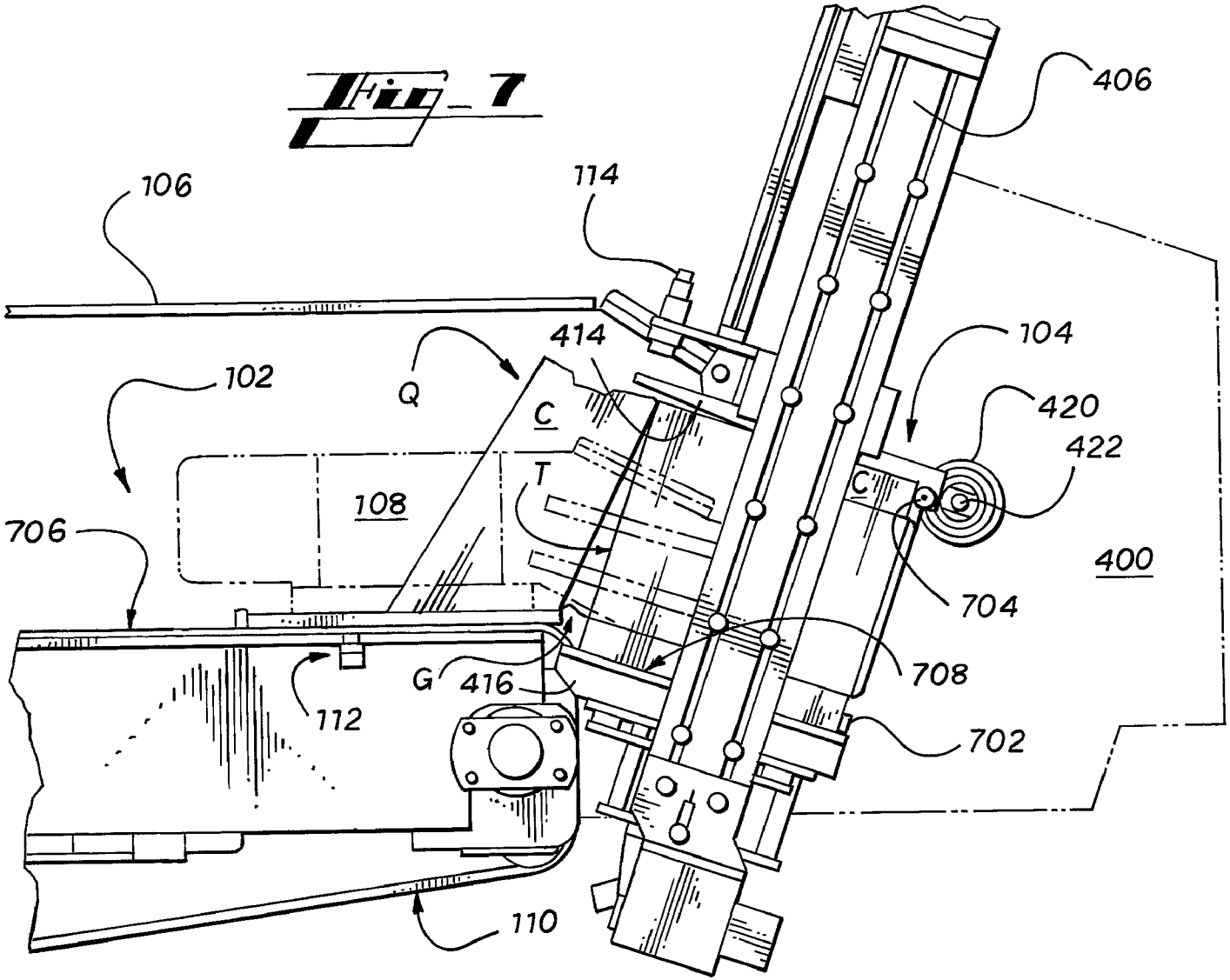
FIG. 7 is a side elevation view of the infeed station of FIG. 1.

FIGS. 4 and 5 provide additional detail regarding the major components of the exemplary magazine 104. The magazine 104 is mounted to the frame (not shown) of the packaging machine via vertical support plates 400, 402. An upper detent bar 404 and a lower detent plate assembly 418 extend horizontally between two vertical tracks 406, 408. The upper detent bar 404 is adjustably engaged by the tracks 406, 408, with its adjustment being controlled via chain 410, so that its elevation relative to a bottom surface 708 (shown in FIG. 7) of the magazine 104 can be changed to accommodate carton blanks C of various dimensions. The front end of the bottom surface 708 of the magazine 104 is angled downward such that carton blanks C entering the rear end of the magazine 104 from the hopper 102 slide toward the front end of the magazine 104. In certain embodiments, the magazine 104 also includes a vibration generator that shakes or otherwise vibrates to align the carton blanks C with respect to one another in the proper position for removal from the front end of the magazine 104. Several prongs 414 that are mounted on the underside of the upper detent bar 404 serve to guide the top edges of carton blanks C from the hopper 102 into the magazine 104, as well as through the magazine 104, without generating excessive friction that would impede the motion of the carton blanks C. Similarly, supports 416 are mounted to the lower detent plate assembly 418 to support the bottom edges of carton blanks C. Referring to FIGS. 5 and 7, support rollers 420, lower detents 702, and upper detents 704 prevent the stack T of carton blanks C from escaping through the front end of the magazine 104 prior to being removed by the pickup wheel 116 of the carton feeder F. The support rollers 420 are mounted on a medial detent bar 422. The lower detents 702 protrude slightly above the bottom surface 708 of the magazine 104 or otherwise above a plane that is defined by the upper surface of the supports 416. The upper detents 704 protrude below the lower surface of the prongs 414.

The ability of the lower detents 702 to retain the carton blanks C in the magazine tends to be undesirably overcome as excessive pressure is applied to the stack T of carton blanks C in the magazine 104. Excessive pressure is prevented at least in part by maintaining a transition region G between the queue Q of carton blanks C in the hopper 102 and the stack T of carton blanks C in the magazine 104. The transition region G is maintained in part by varying the relative elevation and angle of disposition of a bottom surface 706 of the hopper 102, as defined by the upper surfaces of advancing belts 110, relative to the bottom surface 708 of the magazine 104, as defined by the upper surfaces of the supports 416. For example, the bottom surface 708 of the magazine 104 is disposed at an acute angle A (shown in FIG. 9) with respect to the bottom surface 706 of the hopper 102. In addition, the front edge of the bottom surface 706 of the hopper 102 is elevated above the rear edge of the bottom surface 708 of the magazine 104 by a distance D (shown in FIG. 9) or otherwise the maximum elevation of the bottom surface 708 of the magazine 104 is lower than the elevation of the bottom surface 706 of the hopper 102. In other words, no part of the supportive portion of the bottom surface 708 of the magazine 104 breaks the plane of the bottom surface 706 of the hopper 102. The frontmost carton blanks C in the queue Q are tilted forward to pass through the transition region G and the top edges of the frontmost carton blanks C in the queue Q are engaged by the prongs 414 such that the top edges of the frontmost carton blanks C in the queue Q align with the top edges of the carton blanks C in the stack T. Additionally, the upper portion of the frontmost carton blank C in the queue Q abuts the upper portion of the rearmost carton blank C in the stack T. Thereby, the transition region G ensures that any pressure exerted by the queue Q of carton blanks C in the hopper 102 on the stack T of carton blanks C in the magazine 104 is concentrated on the upper portion or upper edges of the stack T of carton blanks C, which is supported by the much more substantial upper detents 704.

Referring to FIGS. 1 and 7, the infeed station 100 further includes sensors 112, 114 that are positioned to detect certain states which are present in the infeed station 100 and to provide signals to the PLC 200 reflecting those states. Generally speaking, the sensors 112, 114 are positioned to, detect the presence or absence of certain portions of carton blanks C at certain locations along the length of the infeed station 100, as described in further detail below. Thereby, the sensors 112, 114 output or indicate states which define a condition and the PLC 200 issues or triggers a corresponding response.

Figure 3:
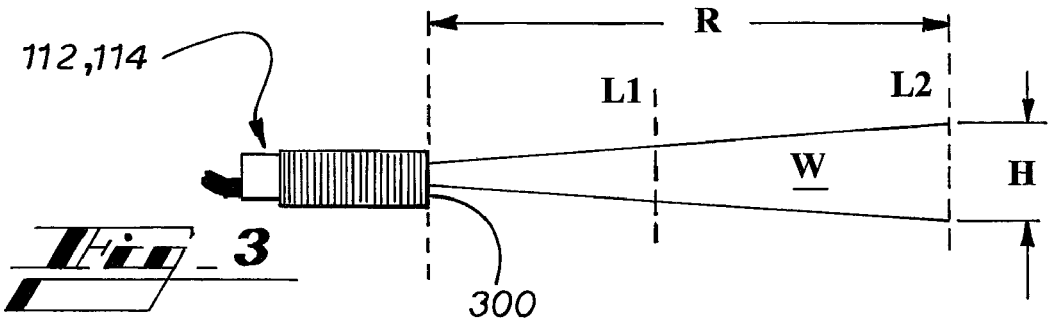
FIG. 3 is a diagram showing the sensing window of a sensor that is integral to the infeed station of FIG. 1.

Both sensors 112, 114 may be of the same type, which in the embodiment described is an ultrasonic threaded cylindrical proximity sensor with an 18 mm diameter, such as the SM650A-216-00 Superprox® model manufactured by Hyde Park Electronics LLC of Dayton, Ohio, although any suitable known or yet to be developed sensor may be used to detect presence or proximity or any other suitable parameter that would trigger the desired response as described herein. With reference to FIG. 3, the exemplary sensors 112, 114 are normally configured to detect objects within a fixed sensing field or window W, which is defined by a near limit L1, a far limit L2, and a beam width. The beam width may be variable along a notional central axis that extends perpendicularly from a sensing face 300 of the sensor 112, 114. Each sensor 112, 114 has a maximum beam width, referred to herein as scope H, that is measured in a direction that is substantially perpendicular to the notional central axis of the sensor 112, 114. The distance between the sensing face 300 of the sensor 112, 114 and the far limit L2 is also referred to as a sensing range R.

The sensor 112, 114 is configured such that it does not detect objects outside the window W. Specifically, the sensor 112, 114 does not detect objects located in a deadband region, which is the space between the sensing face 300 of the sensor 112, 114 and the near limit L1, or objects located beyond the sensing range R. In certain embodiments, the near limit L1 of the sensors 112, 114 is one inch and the far limit L2 is two inches, yielding a sensing window W with a length of one inch in the direction defined by the notional central axis.

Each sensor 112, 114 changes state to reflect the presence or absence of objects within the window W of the sensor 112, 114. The state of each sensor 112, 114 is periodically or continuously scanned or sampled by the PLC 200 and the combined states define a condition which corresponds to a command to be triggered or issued by the PLC 200. In the exemplary embodiment, each of the sensors 112, 114 outputs one of two state indicators. When an object is detected in the window W of the sensor 112, 114, the sensor 112, 114 outputs or indicates a "detected" state and when an object has not been detected in the window W of the sensor 112, 114, the sensor 112, 114 outputs or indicates a "not detected" state. Alternatively, rather than outputting a state, the sensor may output a quantitative measurement of a parameter that is processed by the PLC 200. For example, the parameter may be a distance from the sensor and the distance can be processed by the PLC 200 to define multiple states including a state that indicates a loading error.

It is envisaged that the sensor 112, 114 indicates a state when the parameter detected by the sensor 112, 114 falls between certain predefined limits. Further, if the parameter detected is proximity or presence, the sensor may indicate a state only if the parameter falls between certain predefined limits for a certain amount of time. The predefined limits can be integral to the sensor or incorporated into the PLC program. As a hypothetical, the PLC may sample the output signal, i.e. the state, of a sensor X times per second. However, the PLC may be programmed to trigger a particular response only if the states of the sensors indicate a corresponding condition in Y consecutive samples, or if a condition is met for any percentage of Y consecutive samples. It should be understood that the samples of the states of the sensors can be processed and combined in any manner, by circuitry integral to the sensor or programmed into the PLC, to define a condition which is sampled by the PLC in order to determine a response.

Referring to FIG. 7, for the infeed station 100 to function properly, carton blanks C from the queue Q are added to the stack T of carton blanks C as the carton feeder F removes carton blanks C from the stack T such that the infeed station 100 provides a continuous supply of carton blanks C to the carton feeder F. Accordingly, the advancing belts 110 are controlled such that the advancing belts 110 are driven to add carton blanks C from the queue Q to the stack T and stopped to prevent excessive back pressure on the stack T. The sensor 114 is positioned to determine when carton blanks C are to be added to the stack T or otherwise to determine when the stack T is suitably full.

Figure 9:
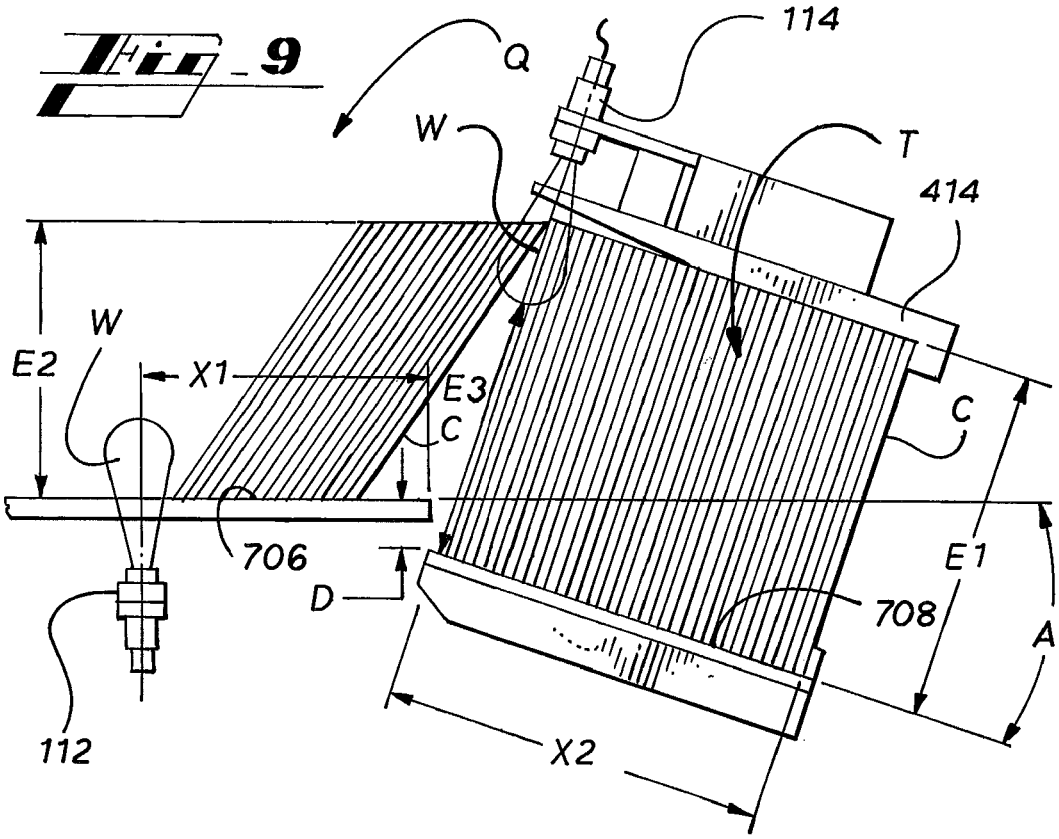
FIGS. 9 and 10 illustrate certain states of the carton blanks within the infeed station of FIG. 1.
Figure 10:
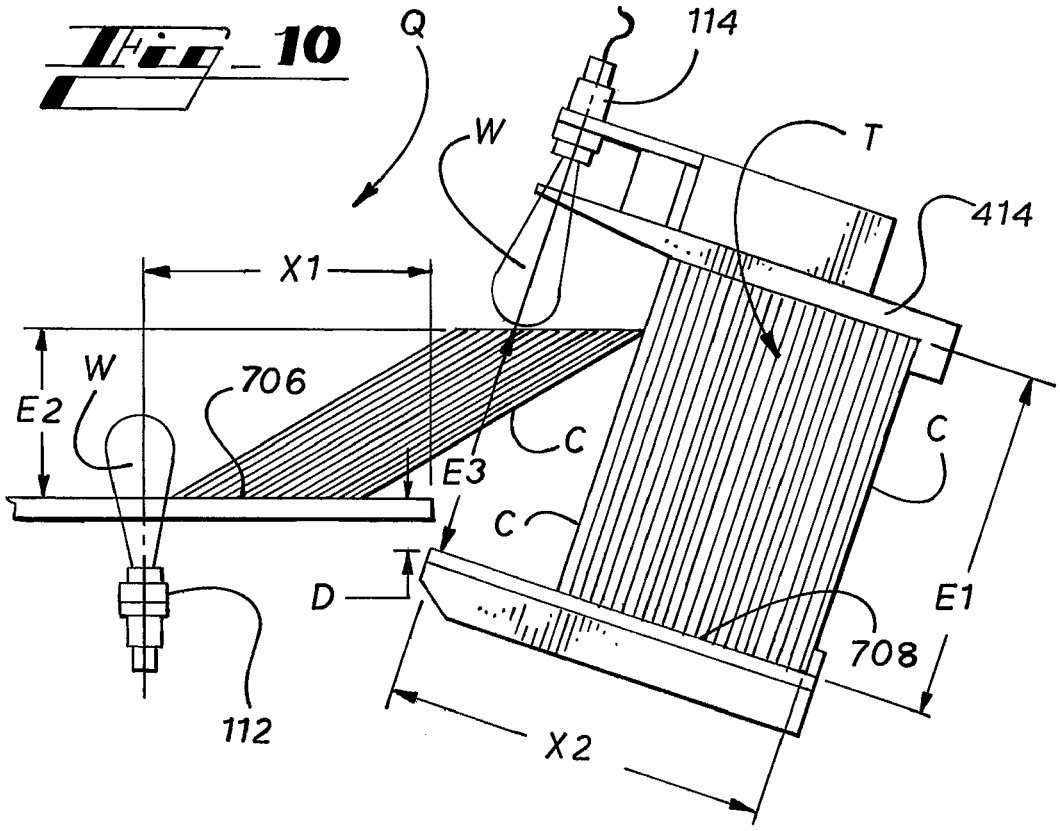

Certain parameters of the stack T and the queue Q reflect the fullness of the stack T. Referring to FIGS. 9 and 10, as the frontmost carton blanks C are removed from the stack T by the carton feeder (not shown), the depth of the stack T is reduced and the remaining carton blanks C move incrementally forward. Consequently, frontmost carton blanks C in the queue Q, which lean against the upper portion of the rearmost carton blanks C in the stack T, tilt forward thereby reducing the elevation E2 of the top ends of the carton blanks C in the queue Q relative to the bottom surface 706 of the hopper 102. The elevation E2 of the top ends of the carton blanks C in the queue Q depends on the depth of the stack T and both these parameters reflect the fullness of the stack T. Further, the depth of the queue Q to reflects whether or not the queue Q is suitably full.

The warning sensor 112 is positioned so as to detect the presence or absence of carton blanks C in the hopper 102 at a distance X1 (shown in FIG. 9) from the front edge of the bottom surface of the hopper 102. The distance X1 is determined to reflect a depth of the queue Q of carton blanks C at which the queue Q is considered suitably full. In the embodiment shown in FIGS. 1 and 7, the warning sensor 112 is disposed between adjacent advancing belts 110 so as to be perpendicular to and below the bottom surface 706 of the hopper 102. That is, to avoid interfering with the procession of carton blanks C in the hopper 102, the sensing face 300 (shown in FIG. 3) of the warning sensor 112 extends no further than the elevation of the valleys between the teeth in the advancing belts 110. Moreover, the distance between the bottom surface 706 and the sensing face 300 of the warning sensor 112 is constrained at least in part by the characteristics of the particular sensor used including the limits L1, L2 of the sensing window W. The warning sensor 112 is directed upward to detect the presence or absence of carton blanks C above the warning sensor 112 on the advancing belts 110 of the hopper 102. The warning sensor 112 is thereby positioned such that the sensing window W is disposed in a space that is adjacent to and above the bottom surface 706, for example, to detect the presence of the bottom edges of carton blanks C in the queue Q. Those skilled in the art will readily appreciate that the sensors 112, may be positioned in alternate locations, including along the sides of the hopper 102 and directed inward, above the hopper 102 and directed downward, or at any vantage point that offers an unobstructed path to detect the presence or absence of carton blanks C in the hopper 102.

The control sensor 114 is positioned to detect the presence of carton blanks C in or around the transition region G between the hopper 102 and the magazine 104 and in doing so reflect whether the stack T is suitably full. The control sensor 114 is mounted between prongs 414, above a plane defined by the bottom surfaces of the prongs 414, and approximately at a distance X2 from the front end of the magazine 104. The distance X2 corresponds to the depth of the stack T at which the magazine 104 is considered suitably full. Further, the distance X2 is defined between a plane that is defined by the surface of the frontmost carton blank C in the stack T and the notional central axis of the sensor 114. Referring to FIG. 4, the control sensor 114 is mounted to the upper detent bar 404 by a mounting plate 412 that extends from the upper detent bar 404 toward the hopper 102. The length of the mounting plate 412 is at least partially determinative of the extent to which the control sensor 114 is offset from the upper detent bar 404. The distance between the plane defined by the bottom surfaces of the prongs 414 and the sensing face 300 is controlled at least in part by the characteristics of the particular sensor used including the limits L1, L2 of the sensing window W. The control sensor 114 is directed downward to detect the presence or absence of carton blanks C disposed or passing below the control sensor 114. The control sensor 114 is thereby positioned such that the sensing window W is disposed in a space that is adjacent to and below the prongs 414. Thereby, the control sensor 114 can detect the presence of the top edges of carton blanks C that are suitably upright in the stack T and/or the queue Q. Specifically, the control sensor 114 is positioned to detect the presence of the top edges of the frontmost carton blanks C in the queue Q when the elevation E2 of the queue Q is such that the top edges of frontmost carton blanks C in the queue Q are adjacent to the prongs 414 or otherwise such that the elevation E2 corresponds to an elevation E3 relative to the bottom surface 708 of the magazine 104. The dimensions and position of the window W of the sensor 114 define the elevation E3. In the exemplary embodiment, the elevation E3 is measured relative to the bottom surface 708 of the magazine 104. However, the elevation E3 can be measured relative to any surface including the bottom surface 706 of the hopper 102. It should be noted that the elevation at which the top ends of the frontmost carton blanks C in the queue Q are present in the window W is dependent on the size and shape of the window W and the sensor 114 can be positioned to adjust the elevation at which the top ends of the frontmost carton blanks C in the queue Q are present in the window W.

It should be noted that the extent of the scope H and the thickness of the carton blanks C determine the number of carton blanks C that are detected by each sensor 112, 114. In the exemplary embodiments, the sensor 112, 114 may signal a condition when one or more of the carton blanks C within the scope H are detected. In alternative embodiments, a certain number of carton blanks C are preferred to be detected in order to indicate a state.

It should be understood that the limited sensing range R of the control sensor 114 offers the advantage of ignoring any carton blank C that is aligned in the direction of the control sensor 114, but is tilted to an unacceptable degree such that the top edge of the carton blank C is disposed below an elevation corresponding to the elevation E3. For example, in the exemplary embodiment, the two inch sensing range R ensures that any carton blank C that is tilted such that its upper edge is more than two inches away from the sensing face 300 is not detected by the control sensor 114. Thus, if a carton blank C is tilted beyond a predetermined acceptable angle, its upper edge will escape the sensing range R. In response, the PLC 200 is programmed to increase the rate of advancement of the advancing belts 110 to correct the tilt of the excessively tilted carton blanks C. The duration of this increase may be limited so as to distinguish between a temporary condition, i.e., a tilted carton blank C, and a condition that will persist without intervention, i.e., absence of carton blanks C.

The sensors 112, 114 are positioned on the infeed station 100 and the PLC 200 can be programmed, as described below, such that the driving mechanism for the advancing belts 110 is controlled to properly feed carton blanks C through the infeed station 100. Specifically, the command issued or the response triggered by the PLC 200 is dependent on the condition that is defined by the states that are indicated by the sensors 112, 114. For example, a condition "A" is defined when the warning sensor 112 indicates a "detected" state and the control sensor 114 indicates a "detected" state. In this instance, the depth of the stack T and the depth of the queue Q are such that the magazine 104 and the hopper 102 are suitably full. When condition "A" is scanned or sampled by the PLC 200, the PLC 200 disables the advancing belts 110 or otherwise does not command the advancing belts 110 to be driven.

A condition "B" is defined when the warning sensor 112 indicates a "detected" state and the control sensor 114 indicates a "not detected" state. In this instance, the depth of the queue Q is such that the hopper 102 is suitably full, but the depth of the stack T is such that the magazine 104 is not suitably full and the queue Q is substantially tilted. In response to condition "B", the PLC 200 causes the advancing belts 110 to be driven to move the frontmost carton blanks C in the queue Q through the transition region G to be added to the stack T and/or to cause the carton blanks C in the queue Q to become substantially upright. In other words, the elevation E2 of the top ends of the carton blanks C in the queue Q relative to the bottom surface 706 of the hopper 102 is increased.

A condition "C" is defined when the warning sensor 112 indicates a "not detected" state and the control sensor 114 indicates a "detected" condition. In this instance, the depth of the stack T is such that the magazine 104 is suitably full but the depth of the queue Q is such that the hopper 102 is not suitably full. Accordingly, with continued operation in this state, the queue Q cannot continue to replenish the stack T. In response to condition "C", the PLC 200 issues a warning signal to an operator from an alarm output 202. The warning signal may include an audible, visible, or vibratory alert, or any other signal or event that is detectable by a human or automated operator, such as a computerized voice. Therefore, the alarm output 202 may be any suitable output device, such as a siren, display screen, vibration table, speaker, and the like.

A condition "D" is defined when the warning sensor 112 indicates a "not detected" state and the control sensor 114 indicates a "not detected" condition. In this instance, the depth of the stack T is such that the magazine 104 is not suitably full and the depth of the queue Q is such that the hopper 102 is not suitably full. Accordingly, with continued operation in this state, infeed station 100 cannot continuously feed carton blanks C to the carton feeder F. In response to condition "D", the PLC 200 shuts the packaging machine down.

Figure 2:
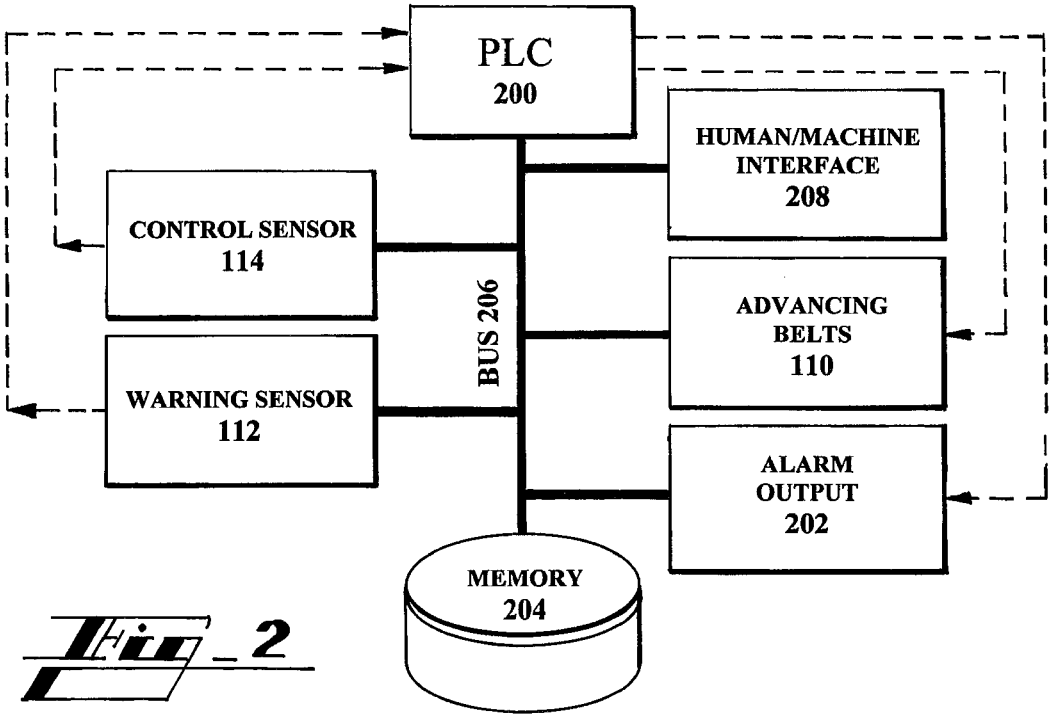
FIG. 2 is a block diagram showing the functional connections and the flow of data between certain of the various elements of an embodiment of the present invention.

Referring to FIG. 2, the PLC 200 may be programmed directly, or the logic programs may be downloaded or relayed from a computer (not shown). The PLC 200 has either modular or integral input/output circuitry that monitors the signals of field connected sensor inputs, including sensors 112 and 114, and controls attached output actuators, including devices such as motor starters, solenoids, pilot lights/displays, drives, vacuum valves, and the like (not shown) according to the programs stored in the random-access (RAM) portion of memory 204. A system bus 206 couples memory 204, sensor inputs, and output actuators to the PLC 200. If the PLC 200 receives programming from a computer, the computer typically further includes additional computer-readable media, such as low speed storage, such as a hard disk drive or a magnetic disk drive, and the like, to read from or write to a removable disk, and an optical disk drive for reading a CD-ROM disk or to read from or write to other optical media. The hard disk drive, magnetic disk drive, and optical disk drive include a hard disk drive interface, a magnetic disk drive interface, and an optical drive interface, respectively (not shown), for coupling the drives to the system bus 206. The drives and their associated computer-readable media provide nonvolatile storage for the computer. Although the description of computer-readable medium above refers to a hard disk, a portable USB drive, a removable magnetic disk, a CD-ROM disk, other types or media readable by a computer, such as magnetic cassettes, flash memory cards, digital video disks, Bernoulli cartridges, and the like, can also be used.

A number of program modules can be stored in the drives and in the RAM portion of memory 204, including an operating system, one or more application programs, a shared code library, and a browser program module. A user may enter commands and information into the computer through a human/machine interface (HMI) 208, such as but not limited to a keyboard and pointing device, such as a mouse. The HMI 208 may incorporate other input/output devices such as a microphone, joystick, scanner, pushbuttons, LEDs, and the like. These and other input/output devices may be connected to the PLC 200 or the processing unit of the computer through a serial port interface coupled to the system bus 206, but can be connected by other interfaces, such as a universal serial bus (USB) (not shown). The input/output devices include a monitor or other type of display device connected to the system bus 206 via an interface, such as a video adapter. In addition to the monitor, computers typically include other peripheral output devices, such as speakers or printers.

Figure 8:
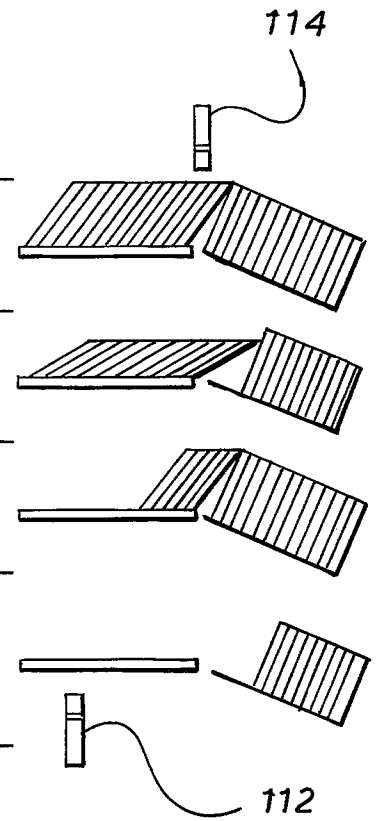
FIG. 8 is a chart showing the interoperability of the warning and control sensors according to certain embodiments of the invention.

According to an exemplary method, the carton blanks C are loaded into the hopper 102 and into the magazine 104, and the PLC 200 begins scanning or sampling the condition defined by the states that are indicated by the warning sensor 112 and the control sensor 114. As shown for condition "A" in the chart of FIG. 8, the warning sensor 112 detects the carton blanks C in the hopper 102, and assuming the carton blanks C were properly loaded, the control sensor 114 detects the top edges of the frontmost carton blanks C in the queue Q. The output of each of the sensors 112, 114 indicates a "detected" state, thereby defining the condition "A", so the PLC 200 takes or triggers no action with respect to the advancing belts 110. Meanwhile, the carton feeder wheel 116 removes carton blanks C from the magazine 104, commonly at high rates of speed such as five per second, thereby decreasing the depth of the stack T. As the depth of the stack T decreases, the tilt of the carton blanks C in the queue Q increases, causing the elevation E2 of the top edges of the frontmost carton blanks C to fall below the sensing range R of the control sensor 114. Thereby, the PLC 200 detects condition "B" and, in response, advances the advancing belts 110 to return the system to condition "A". In the event that the queue Q is depleted, the warning sensor 112 fails to detect carton blanks C in the hopper 102 and the PLC 200 detects condition "C", which indicates that the depth of the queue Q is less than a predetermined limit and may be depleted if the hopper 102 is not reloaded. In response, the PLC 200 causes a warning signal to issue via alarm output 202. According to certain embodiments, the PLC 200 is programmed to only issue the warning signal after the output of the warning sensor 112 has been off for a certain period of time, e.g., 30 seconds. This is to prevent alerting the operator to load carton blanks C when the sensor 112 has merely detected transient gaps between carton blanks C that are already loaded in the hopper 102. If carton blanks C are not loaded in the hopper 102 in response to the warning signal, the queue Q is eventually depleted, and the control sensor 114 fails to detect the top edges of carton blanks C in the queue Q or in the stack T. Condition "D" is then detected, causing the PLC 200 to shut the packaging machine down when the program conditions are met, including applying any predefined delays.

Those skilled in the art will readily appreciate that, as used herein the phrases "advancing the advancing belts" or "stopping the advancing belts" (and variants thereof) may refer to alterations of the rate of advancement of the carton blanks relative to the normal operating speed of the advancing belts. In other words, it is contemplated that when the hopper is full, the advancing belts advance continuously according to the rate at which the feeder removes carton blanks from the magazine. When cartons tilt, the advancing belts simply increase the rate of advancement above the normal operating speed to compensate and close the gap. Once the gap is eliminated, the advancing belts return to normal operating speed, and thus, may never completely stop.

The present invention has been illustrated in relation to a particular embodiment which is intended in all respects to be illustrative rather than restrictive. Those skilled in the art will recognize that the present invention is capable of many modifications and variations without departing from the scope of the invention. For example, design choices such as the type of sensors and PLCs or variations in programming will introduce certain delays in the timing of the certain of the events described above. The scan rate of the particular PLC will determine how long a condition or state may exist before the PLC controls peripheral devices accordingly. The characteristics of the motor and drive system controlling the advancing belts may include limitations that demand additional logic and/or delays to avoid exceeding such restrictions as duty cycle and maximum allowable starting frequency. Similarly, the placement of sensors may also vary according to the depth of the magazine, length of the hopper, speed of the packaging machine, carton type and dimensions, frequency and speed of the operator to reload the hopper, and similar parameters. With respect to the type of sensors used, sensors having an on/off delay may be preferred in certain applications such as to prevent excessive starting of the advancing belt motors due to transient gaps between carton blanks C.

As used herein, directional references such as "top", "base", "bottom", "end", "side", "inner", "outer", "upper", "middle", "lower", "front" and "rear" do not limit the respective walls and edges of the cartons or carton blanks to such orientation, but merely serve to distinguish these walls from one another.

Those skilled in the art will also appreciate that the packaging machine described represents only one example of the various packaging machine types and configurations that will be suitable for implementation of the various embodiments of the invention. In addition, any suitable picking and placing device may be used in addition to or instead of vacuum cup stations, including magnets, non-permanent adhesives, and the like. The exemplary vacuum stations may utilize any negative pressure generating devices and principles, including without limitation, Venturi or Bernoulli vacuum devices, which may but do not necessarily contact the surface of the article to be engaged and disengaged. Accordingly, the scope of the present invention is described by the claims appended hereto and supported by the foregoing.

What is claimed is:

1. An infeed station, comprising:

a magazine configured to hold carton blanks in position for sequential removal by a carton feeder;

a hopper configured to supply the magazine with carton blanks, the hopper and the magazine being configured such that there is an abrupt drop off of the downstream end of the hopper onto the upstream end of the magazine; and a control sensor configured to generate a control sensor signal when the angle of carton blanks on the hopper exceeds a predetermined maximum.

2. The infeed station of claim 1, the magazine comprising an upper surface configured to support upper ends of carton blanks.

3. The infeed station of claim 2, the magazine further comprising:

a lower surface configured to support lower ends of carton blanks; and an upper detent and a lower detent that are respectively positioned at the downstream end of the upper surface and the lower surface of the magazine, the upper detent and the lower detent being configured to respectively contact an upper portion and a lower portion of a downstream-most carton blank in the magazine to hold carton blanks in the magazine.

4. The infeed station of claim 3, wherein the upper detent is configured to provide a greater amount of support than the lower detent.

5. The infeed station of claim 1, wherein the abrupt drop separates the hopper and the magazine such that the lower ends of carton blanks supplied by the hopper are prevented from applying pressure to carton blanks held in the magazine.

6. The infeed station of claim 1, wherein the abrupt drop is defined by a substantially vertical distance.

7. The infeed station of claim 6, wherein the vertical distance is defined between a lower surface of the hopper and a lower surface of the magazine that are respectively configured to support lower ends of carton blanks.

8. The infeed station of claim 7, wherein the lower surface of the magazine is at an angle with respect to the lower surface of the hopper.

* * * * *